US005369729A

United States Patent [19]

Norris

[11] Patent Number: 5,369,729

[45] Date of Patent: Nov. 29, 1994

[54] CONVERSIONLESS DIGITAL SOUND PRODUCTION

[75] Inventor: David C. Norris, Redmond, Wash.

[73] Assignee: Microsoft Corporation, Redmond, Wash.

[21] Appl. No.: 848,047

[22] Filed: Mar. 9, 1992

[51] Int. Cl.[5] ..... G10L 9/00

[52] U.S. Cl. ..... 395/2.67

[58] Field of Search ..... 395/2.67, 2.74; 381/51-53

[56] References Cited

U.S. PATENT DOCUMENTS

| | | | |
|---|---|---|---|
| 4,617,645 | 10/1986 | Sprague | 365/45 |
| 4,692,941 | 9/1987 | Jacks et al. | 381/52 |
| 4,805,220 | 2/1989 | Sprague et al. | 381/51 |
| 4,883,718 | 5/1989 | Sprague | 381/52 |
| 4,888,806 | 12/1989 | Jenkin et al. | 381/35 |
| 5,029,213 | 7/1991 | Kachikian et al. | 381/51 |
| 5,054,086 | 10/1991 | Witzel | 381/51 |
| 5,095,509 | 3/1992 | Volk | 395/2.67 |

OTHER PUBLICATIONS

"The New Peter Norton Programmer's Guide To The IBM PC & PS/2", Microsoft Press, First Edition, 1985 by Peter Norton.

*Primary Examiner*—David D. Knepper

*Attorney, Agent, or Firm*—Seed and Berry

[57] ABSTRACT

Relatively high sound quality is produced from a standard computer speaker without using a digital to analog converter. Error propagation techniques are used to position the cone of a speaker at a position proportional to a waveform sample. Hysteresis may be employed to retard the frequency of the positional changes of the speaker cone to increase the volume of the speaker. An interpolative technique may be employed to produce a smoother transition between waveform samples.

20 Claims, 4 Drawing Sheets

CONVERSIONLESS DIGITAL SOUND PRODUCTION

TECHNICAL FIELD

This invention relates to digital sound production, and more particularly, to the production of sound corresponding to waveform samples from a personal computer speaker.

BACKGROUND OF THE INVENTION

It has long been known how to electronically reproduce complex sounds such as speech or music. The methods employed to reproduce such sounds have typically been analog in nature. Although the sound quality of these methods is high, the analog signals used cannot be made or processed by digital personal computers.

To allow computers to process complex sounds, the analog sounds are converted to digital representations using an analog to digital converter. The converter periodically samples the analog waveform and provides a series of sample values to the computer. This is called pulse code modulation (PCM) and is a common way to represent analog waveforms digitally. The computer can then process the samples in any desired manner to accomplish the objectives of the user. Conventionally, the processed samples are applied to a digital to analog converter (DAC), which produces an analog waveform that can be heard via the computer's speaker.

The problem with this method is that the standard IBM-compatible personal computer does not have a DAC to create analog signals. Although one could purchase a DAC and connect it to the computer, this may be too expensive, too complicated, and/or simply too much trouble for the ordinary user. Therefore, it is desirable to produce sound using a standard personal computer without employing any additional hardware.

The hardware used to produce sound on a standard IBM PC or compatible computer 10 is shown in FIG. 1. For more technical detail on the computer speaker hardware, one should refer to the IBM XT or AT Reference Manual. Timer 14 is contained on an Intel 8253 timer chip. This chip, or its equivalent, is contained in almost every personal computer. The Parallel Port Interface (PPI) 16 is an Intel 8255A parallel port interface chip, or its equivalent, which again is contained in almost every personal computer.

There are two "orthodox" ways to make a computer speaker 22 produce sound. In the first method (the "timer" method), a CPU 12 programs the timer 14 to pulse at a desired frequency. The PPI 16 controls the transmission of the timer pulses through an AND gate 18 to the speaker 22. The speaker will then emit a harsh tone of the desired frequency, because a pure square wave is being sent to the speaker.

The second method (the "direct" method) manipulates the speaker 22 directly by turning the PPI 16 on and off in an infinite loop, thus manufacturing a square wave. In the direct method, the timer 14 is not used to create a square wave so there is no need for the AND gate 18. The frequency of the sound is controlled simply by controlling the speed of the CPU program which controls the amount of time between ON pulses to the PPI 16.

More detailed explanations and programming information for these two basic methods can be found in Peter Norton's book, "The New Peter Norton Programmer's Guide to the IBM PC & PS/2." Even though the book was first written in 1985, at page 152, he hints that it may be possible to generate more than simple tones from the speaker:

> "As far as we know, there is only one advantage to making sounds using the direct method: With the proper control over the program delays, the direct method lets you make a low-fidelity polyphonic sound. Be forewarned, though, that this requires some very clever and tedious programming and, all in all may not be worth the trouble."

With the present invention, making low-fidelity sounds requires very little tedious programming.

SUMMARY OF THE INVENTION

A method of producing sound from a standard computer speaker having a speaker cone, comprising retrieving a present sample value from a series of digital waveform sample values; determining whether the present sample value minus a present error value is greater than a threshold value; turning ON the speaker if the present sample value minus the present error value is greater than the threshold value; turning OFF the speaker if the present sample value minus the present error value is not greater than the threshold value; computing a new error value; and for one or more iterations, repeating the steps beginning with the determining step using the new error value in place of the present error value, such that the speaker cone is positioned to emit sound corresponding to the present sample value.

One method computes the new error value by computing the difference between a speaker value corresponding to the action (turning ON or OFF) most recently done to the speaker and an adjusted value equal to the present sample value minus the present error value minus an increment of the difference between the present sample value and a new sample value.

In another method, the threshold value equals a negative hysteresis value when the most recent action done to the speaker was to turn it ON and the threshold value equals a positive hysteresis value when the most recent action done to the speaker was to turn it OFF.

DETAILED DESCRIPTION OF THE INVENTION

Figure 1:
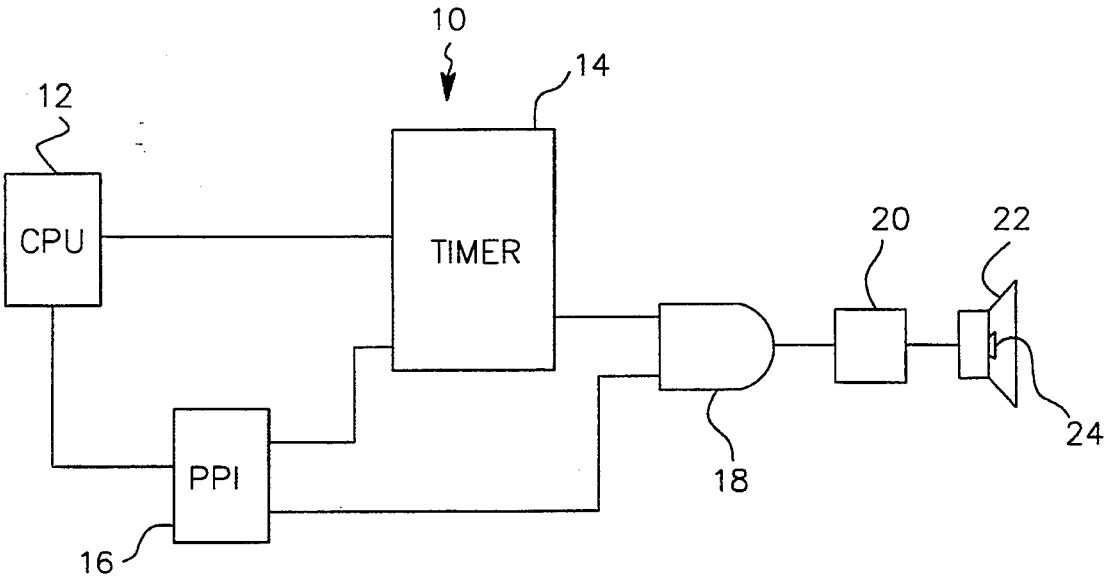
Fig. 1 (PRIOR ART)
FIG. 1 is a block diagram of prior an computer speaker hardware.

Using the hardware of a standard computer 10 shown in FIG. 1, only logic 0 and logic 1 speaker bits can be sent to the speaker 22. However, to play waveforms (as does a radio speaker) a varying voltage must be applied to the speaker, and one that varies in proportion to a specific waveform. The origin of the waveform isn't of particular significance; it usually originates in a microphone somewhere and gets converted to a proportional voltage acceptable to the speaker used. When using the hardware of the standard computer 10, the task is to position a speaker cone 24 of the speaker 22 using a single bit of information.

Figure 2:
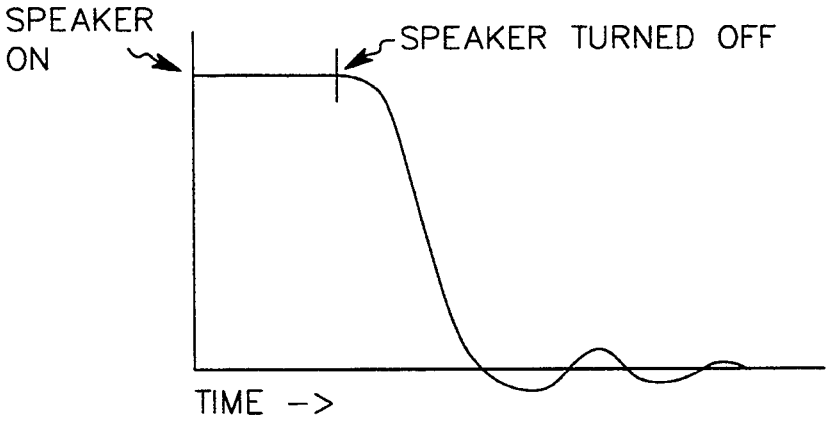
Fig. 2 (PRIOR ART)
FIG. 2 is a graph of the speaker cone response of the prior art speaker of FIG. 1.

FIG. 2 shows the speaker cone response of a prior art speaker 22. The speaker 22 is at an ON position as a result of a logic 1 speaker bit from PPI 16 having been sent to the speaker 22 to turn it on. Next a logic 0 speaker bit from the PPI 16 is used to turn the speaker 22 off. Of course, the speaker is a physical device and subject to the laws of momentum and inertia, so it cannot make the distance from the ON position to an OFF position instantaneously. It will take some time to move that distance and "settle" into the new position. This time is purely dependant on the physical characteristics of the speaker. FIG. 2 demonstrates the actual position of the speaker cone 24 over time after the speaker 22 has been turned OFF and illustrates the full range of speaker cone travel.

Figure 3:
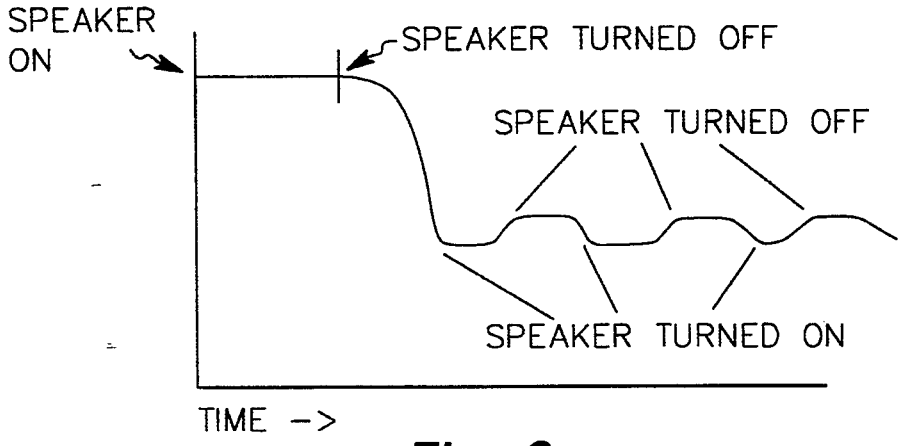
FIG. 3 is a graph of the speaker cone response using the error propagation of the present invention.

The physical speaker dampening and the CPU 12, which is incredibly fast when compared to the response time of the speaker 22, can be used to change the speaker bit fast enough to position the speaker cone 24 wherever desired. For example, by turning the speaker ON and OFF fast enough, with an equal amount of time ON and OFF, the speaker can be positioned in the exact center of its range as shown in FIG. 3.

As can be seen, when the speaker cone approaches the halfway mark, the speaker can be turned back ON. The speaker cone 24 must slow down, stop, and begin moving in the opposite direction. Before it can move too far, the speaker is turned back OFF, and it slows down, stops, and reverses its direction of travel. In such manner, the speaker cone 24 can be maintained in a position at any desired location.

The speaker cone 24 can be moved to a different position by simply changing the amount of time the speaker 22 is held ON versus the amount of time it is held "OFF."A PCM-encoded waveform can be played on the speaker 22 by positioning the speaker cone 24 at a position proportional to a particular sample in a waveform, and repeating the process for every subsequent sample of the waveform for its entire length.

In accordance with the present invention, an error-propagation method is used for determining the amount of time the speaker 22 spends ON and OFF for a given wavesample. The error-propagation method allows the calculation to be accomplished in real time.

The inventive error-propagation method may be used with any series of digital waveform sample values. The series may be received in a stream directly from an analog to digital converter or preferably, is stored in the computer's memory. Each sample value is then selected and retrieved from memory by the inventive error-propagation software.

The inventive error-propagation method receives a waveform sample value that lies between a value corresponding to logic 1 and a value corresponding to logic 0. The method sends a logic 1 speaker bit to turn on the speaker 22 each time that an adjusted value, equal to the sample value minus an error value, is greater than a threshold value such as zero. When the adjusted value is less than the threshold value, the method sends a logic 0 speaker bit to turn the speaker OFF. The error value is computed by subtracting the adjusted value from the value corresponding to logic zero. The method is repeated for a plurality of iterations for each sample value before turning to the next sample value.

For example, assuming that 8-bit sample values are used so that sample values range from 0 to 255 (0×00 to 0×FF in standard C language hex notation), and that the sample value is 192(0×C0). This would seem to require that the speaker bit must be logic 1 for 3 times out of 4 to position the speaker correctly ($192/256=\frac{3}{4}$, or a 75% ON position). Since the speaker 22 cannot directly accept any values except those corresponding to logic 1 (256 or 0×100 in standard C language hex notation) and logic 0 (0 or 0×00) whenever a value is output to the speaker, there will be some error. With the present invention, this error is carried over to the next iteration, or propagated, to achieve the desired results.

Figure 4:
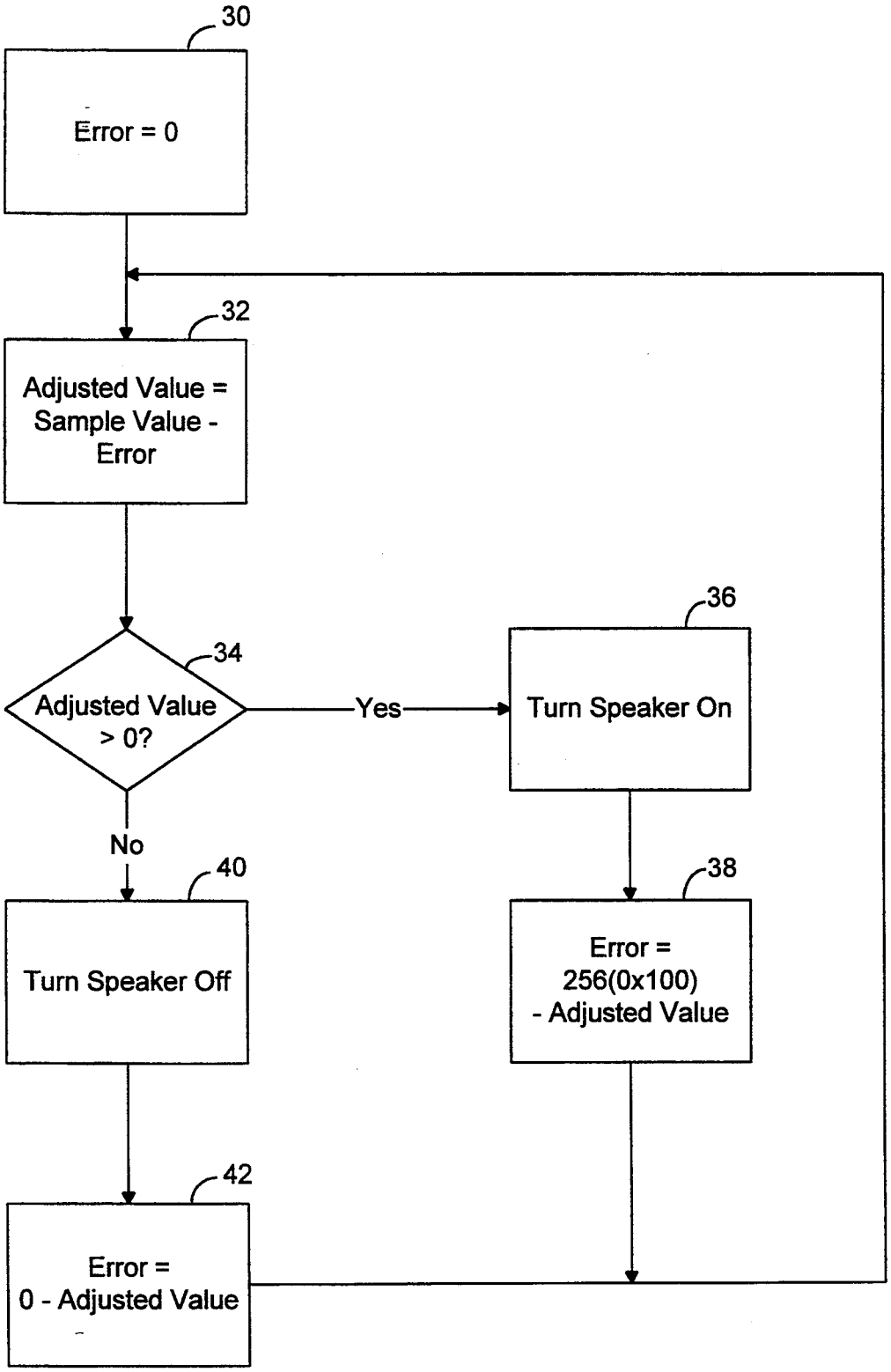
FIG. 4 is a flowchart of an error propagation routine for the present invention.

The following Table A, in conjunction with a flowchart shown in FIG. 4, illustrates how the speaker 22 is turned ON and OFF to produce a waveform digitally that closely approximates the original analog waveform.

TABLE A

| Value | Adjusted Value | Speaker | Error Value |
|---|---|---|---|
| 0xC0 | 0xC0 | 0x100 | 0x40 |
| 0xC0 | 0x80 | 0x100 | 0x80 |
| 0xC0 | 0x40 | 0x100 | 0xC0 |
| 0xC0 | 0x00 | 0x00 | 0x00 |

Initially, the error value is set to zero as shown in step 30 of the flowchart shown in FIG. 4. An adjusted value is computed by subtracting the error value from the sample value (step 32). Since the sample value is 0×C0in this example, the adjusted value initially is 0×C0. Since the adjusted value is greater than the threshold value (0) (step 34), the speaker 22 is turned ON (step 36) by sending it a logic 1 speaker bit. The error value is determined by subtracting the adjusted value from the value corresponding to a logic 1 speaker bit (0×100 in the present example) (step 38). The resulting error is 0×40, which means the speaker has been moved too far out. In the next iteration, the sample value remains 0×C0, but there is a propagated error value of 0×40, so the adjusted value becomes 0×80 (step 32). The adjusted value still is greater than the threshold value (0) (step 34), so the speaker is turned ON (step 36), leaving a new error value of 0×80 (0×1000×80) (step 38). In the next iteration, the adjusted value is 0×C0−0×80=0×40. Again the speaker is turned ON and the propagated error increases to 0×C0. In the next iteration, the accumulated error is sufficient to cancel out the waveform sample value, the speaker is turned OFF, and the propagated error value returns to 0.

This process can be repeated indefinitely, and the speaker cone will be positioned in a 75% ON position, conforming to the waveform sample value of 0×C0. However, since a series of waveform samples must be played, one must consider how long to spend doing the error propagation for this wavesample before moving on to the next wavesample, and how long to spend on each iteration of the error-propagation algorithm.

The first timing consideration is the amount of time spent conducting the error-propagation method on each waveform sample value. This is a simple value and is based on the sampling frequency at which the waveform sample values were obtained. Common frequencies used are 11,025 Hz and 22,050 Hz. Typical compact music disks are recorded at a sample rate of 44,100 Hz. This can be accomplished either by (a)using the timer 14 to stop the iterations for the present waveform sample value after a time "T" equal to the sampling period (reciprocal of the sampling frequency), or (b) computing the number of iterations of the error-propagation routine it takes to complete one sampling period of the and stop the routine after the computed number of iterations.

The second timing consideration is how much time to spend on each iteration of the error propagation. This varies according to the speed of the computer 10 and the number of instructions desired by the individual programmer to implement the error-propagation method. The programmer may fine-tune the output by adding or subtracting instructions to alter the timing of the iterations.

One of the problems of the error-propagation method is that it is "too" good. It outputs speaker bits (l's and O's) as fast as possible to produce the best ratio of ON versus OFF to match each waveform sample value. Unfortunately, by moving too fast, the speaker 22 is not able to keep up, and very little volume is produced by the speaker. In addition, a primitive low pass filter 20 connected between the PPI 16 and the speaker 22 prevents high frequency waves from ever reaching the speaker.

Figure 5:
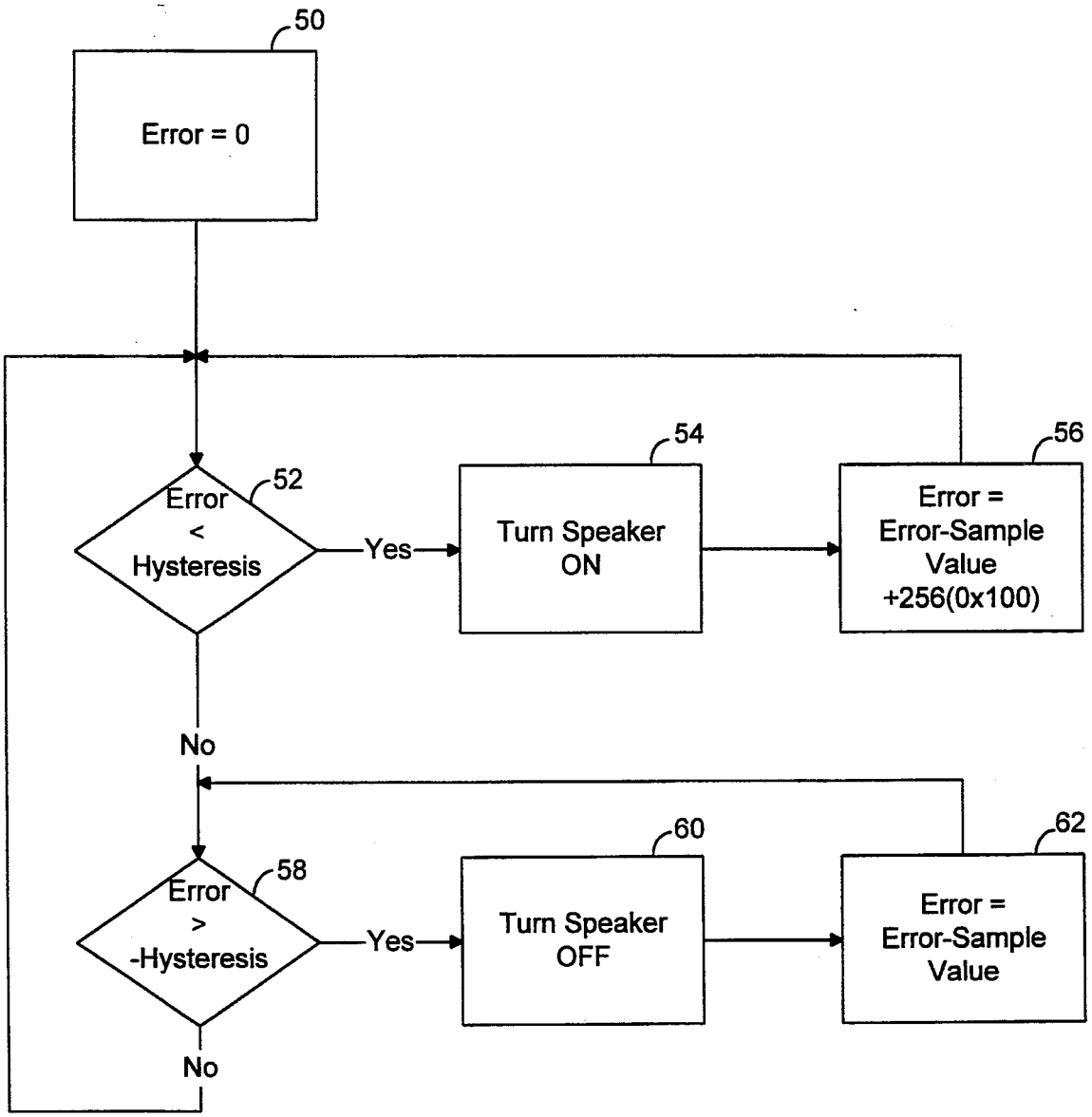
FIG. 5 is a flowchart of an error propagation routine for the present invention employing hysteresis.

In accordance with one aspect of the present invention, hysteresis is used to increase the amount of volume emitted by the speaker 22 by deliberately crippling the error-propagation method used. This is done by using a hysteresis value which forces the error to accumulate in both the positive and negative directions until the hysteresis value is reached. FIG. 5 shows the flowchart for the modified error-propagation method using hysteresis.

As an example, using the previous wavesample value of 192 or 0×C0 and a hysteresis value of 0x100, the following Table B results.

TABLE B

| Error Value | Sample Value | Speaker Value | New Error Value |
|---|---|---|---|
| 0x00 | 0xC0 | 0x100 | 0x40 |
| 0x40 | 0xC0 | 0x100 | 0x80 |
| 0x80 | 0xC0 | 0x100 | 0xC0 |
| 0xC0 | 0xC0 | 0x100 | 0x100 |
| 0x100 | 0xC0 | 0x00 | 0x40 |
| 0x40 | 0xC0 | 0x00 | −0x80 |
| 0x80 | 0xC0 | 0x00 | −0x140 |
| 0x140 | 0xC0 | 0x100 | −0x100 |
| 0x100 | 0xC0 | 0x100 | −0xC0 |
| 0xC0 | 0xC0 | 0x100 | −0x80 |
| 0x80 | 0xC0 | 0x100 | −0x40 |
| 0x40 | 0xC0 | 0x100 | 0 |

The error value is initially set to 0(step 50). Since the error is less than the assumed hysteresis value of 0×100 (step 52), the speaker is turned ON by sending a logic 1 speaker bit to the speaker (step 54). A new error value is computed by adding 0×100 to the difference between the previous error value and the sample value (step 56). It will be appreciated that the error computations for FIGS. 4 and 5 are identical except that FIG. 5 eliminates the intermediate step of computing an adjusted value. The speaker will be turned ON for each iteration until the error value becomes greater than or equal to the hysteresis value (step 52). At that time, the error value also is automatically greater than the negative of the hysteresis value (step 58) so the speaker is tuned OFF by sending a logic 0 speaker bit to the speaker (step 60). A new error value is computed by subtracting the sample value from the previous error value (step 62). If the speaker value corresponding to logic 0 were set at something other than zero, the speaker value would be added to the error value to compute the new error value. As long as the error value remains greater than the negative hysteresis value, the speaker remains turned OFF (steps 58, 60, and 62). When the error value becomes less than or equal to the negative hysteresis value (step 58), it is automatically less than the positive speaker value (step 52), so the speaker is turned ON (step 54).

An alternative way to envision the use of hysteresis can be formed using FIG. 4. Instead of comparing the adjusted value to a threshold value of zero (step 34), the threshold value could be modified to bias the step 34 comparison. When the most recent action on the speaker was to turn it "ON", the threshold value could be set to some negative number to ensure more "Yes" responses consecutively from comparison step 34. When the most recent action on the speaker was to turn it "OFF", the threshold value could be set to some positive number to ensure more "No"responses consecutively from comparison step 34.

The 12 iterations shown in the Table B repeat for the present sample value as long as desired. The ON/OFF ratio is the same as for the basic error propagation ("ON"¾ or 75% of the time), but the speaker is left ON and OFF for much longer periods-OFF for three cycles instead of one, and ON for nine cycles instead of three ("ON"9/12 or 75% of the time). This method allows one to overcome the effects of the low pass filter 20 and provides more energy to the speaker 22, and yet still uses the same basic error-propagation method.

Figure 6:
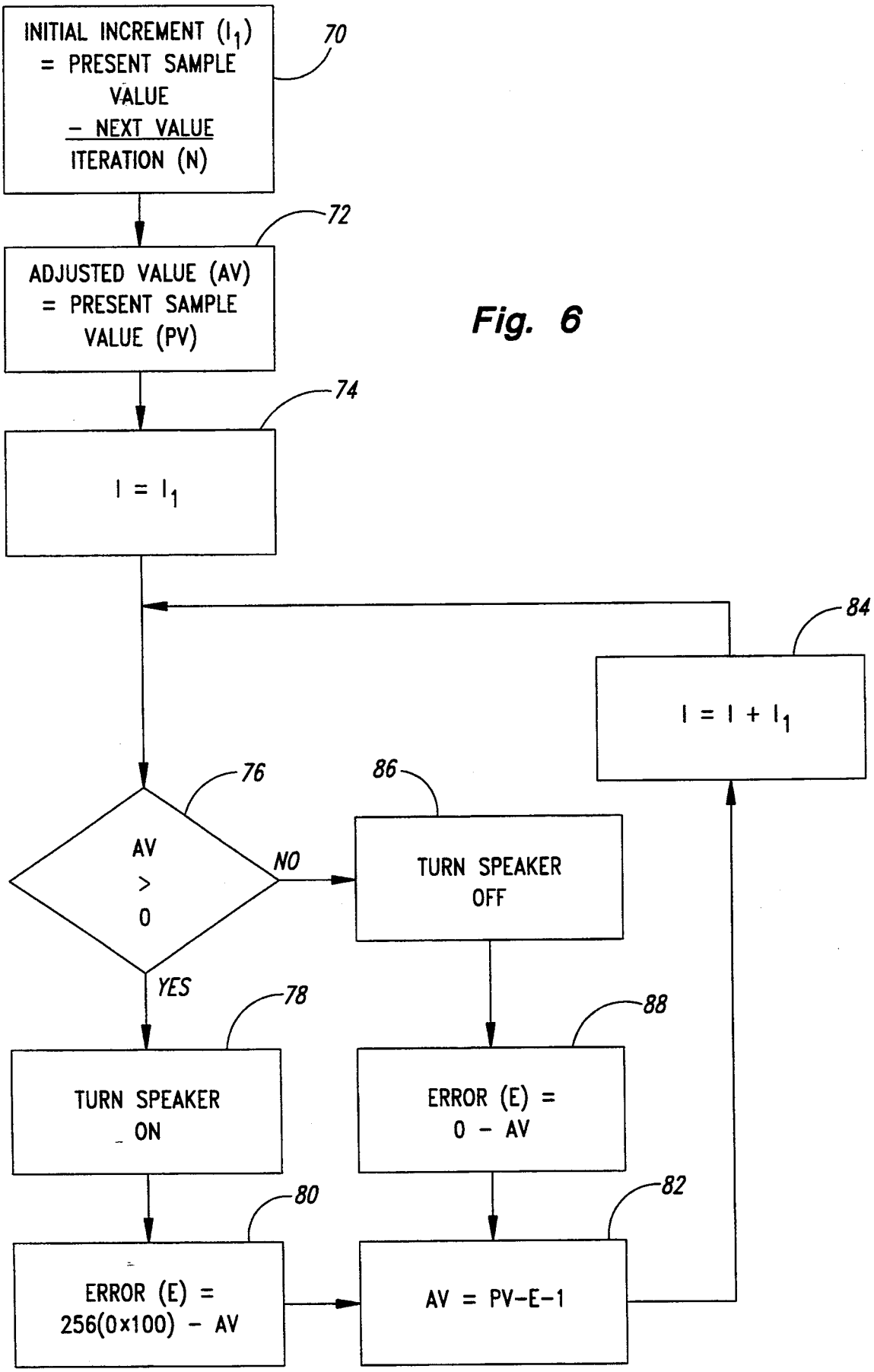
FIG. 6 is a flowchart of an error propagation routine for the present invention employing interpolation.

Normally, a certain amount of time is spent conducting the error-propagation method on a particular waveform sample value, and then the next sample value is used. In accordance with another aspect of the invention, the next sample value is compared to the current sample value, and the adjusted wavesample value is slowly changed over time so as to obtain a smooth curve between the waveform sample values. This process is referred to as interpolation. This process is basically the same as for the basic error-propagation method described above, except that the waveform sample value gradually changes from the current wavesample value to the next waveform sample value. The flowchart shown in FIG. 6 illustrates the interpolation process.

For example, assuming waveform sample value of 0×C0, a next waveform sample value of 0×80, and 8 iterations for each sample value, the following Table C results:

TABLE C

| Interp. Value | Adjusted Value | Speaker | Error Value |
|---|---|---|---|
| 0xC0 | 0xC0 | 0x100 | 0x40 |
| 0xB8 | 0x78 | 0x100 | 0x88 |
| 0xB0 | 0x28 | 0x100 | 0xD8 |
| 0xA8 | −0x30 | 0x00 | −0x30 |
| 0xA0 | 0xD0 | 0x100 | 0x30 |
| 0x98 | 0x68 | 0x100 | 0x98 |
| 0x90 | −0x08 | 0x00 | −0x08 |
| 0x88 | 0x90 | 0x100 | 0x70 |

An initial increment value ($I_1$) is computed by taking the difference between the present sample value and the next sample value and dividing it by the number of iterations to be performed (step 70). An adjusted value (AV) is set to equal the present sample value (PV) (step 72). An increment value (I) is set to equal the initial increment value ($I_1$) (step 74). As shown below, the increment value will be used to bias the speaker 22 toward the next sample value to provide a smooth transition between the present and the next sample values.

The adjusted value (AV) is compared to zero (step 76). Comparison to zero assumes no hysteresis and that the speaker value corresponding to logic 0 is zero. If hysteresis is used, or if another value is set to correspond to logic 0, then the comparison may be modified accordingly.

Since the adjusted value (AV) initially equals the present sample value (assuming the sample values vary from 0×00 to 0×FF), the speaker 22 is initially turned ON (step 78). The error is the difference between the speaker value (0×100 ) and the adjusted value (AV) (step 80). The adjusted value is modified by subtracting the error value (E) from the present sample value (PV), just as was done without using hysteresis or interpolation (step 82). The adjusted value is modified further by subtracting an increment value to bias the speaker toward the next sample value (step 82). The process is repeated with the increment value being increased after each iteration (step 84) to further bias the speaker toward the next sample value. When the adjusted value becomes less than or equal to 0 (step 76), the speaker is turned OFF (step 86). The error value then is computed by subtracting the adjusted value from the speaker value (0 when the speaker is OFF) (step 88). The adjusted value (AV) again is modified by subtracting the error value (E) and the increment (I) from the present sample value (PV) (step 82). The process is continued for a predetermined number of iterations (assumed to be eight in this example) and then the next sample value becomes the present sample value and a new value becomes the next sample value. It will be appreciated that one could increment on every other iteration or on any desired block of iterations.

As shown, the process using interpolation is generally the same as the basic error-propagation method except that an increment value is introduced to bias the speaker toward the next sample value. This provides for a smoother transition between wavesamples and produces a clearer sound.

It will be appreciated that, although specific embodiments of the invention have been described herein for purposes of illustration, various modifications may be made without departing from the spirit and scope of the invention. Accordingly, the invention is not limited except as by the appended claims.

We claim:

1. A method of producing sound from a standard computer speaker having a speaker cone, comprising:

storing a series of digital waveform sample values;

selecting a threshold value;

selecting a present error value;

selecting a present sample value from the series of digital waveform sample values;

retrieving the present sample value selected;

determining whether the present sample value minus a present error value is greater than a threshold value;

generating a first speaker bit if the present sample value minus the present error value is greater than the threshold value;

generating a second speaker bit if the present sample value minus the present error value is not greater than the threshold value;

transmitting the first or second speaker bit generated to the speaker;

turning ON the speaker if the first speaker bit is transmitted;

turning OFF the speaker if the second speaker bit is transmitted;

computing a new error value; and for one or more iterations, repeating the steps beginning with the determining step using the new error value as the present error value, such that the speaker cone is positioned to emit sound corresponding to the present sample value.

2. The method of claim 1 wherein the new error value is computed by computing the difference between a speaker value corresponding to the first or second speaker bit most recently generated and an adjusted value equal to the present sample value minus the present error value.

3. The method of claim 1 wherein the present error value is initially selected as zero.

4. The method of claim 1 wherein the threshold value is selected as zero.

5. The method of claim 1, further comprising repeating the steps of claim 1 beginning with selecting a present sample value for each sample value in the series of digital waveform sample values such that the speaker cone is positioned to emit sound corresponding to the series of digital waveform sample values.

6. The method of claim 1, further comprising selecting a next sample value and selecting an increment of the difference between the present sample value and the next sample value, and wherein the new error value is computed by computing the difference between a speaker value corresponding to the first or second speaker bit most recently generated and an adjusted value equal to the present sample value minus the present error value minus the increment if the next sample value is less than the present sample value and plus the increment if the next sample value is greater than the present sample value.

7. The method of claim 1 wherein the threshold value equals a negative hysteresis value when the most recent speaker bit generated is a first speaker bit and the threshold value equals a positive hysteresis value when the most recent speaker bit generated is a second speaker bit.

8. A method of producing sound from a standard computer speaker having a speaker cone, comprising:

selecting a threshold value;

selecting a present error value;

retrieving a present sample value from a series of digital waveform sample values;

determining whether the present sample value minus a present error value is greater than a threshold value;

turning ON the speaker if the present sample value minus the present error value is greater than the threshold value;

turning OFF the speaker if the present sample value minus the present error value is greater than the threshold value;

computing a new error value; and for one or more iterations, repeating the steps beginning with the determining step using the new error value as the present error value, such that the speaker cone is positioned to emit sound corresponding to the present sample value.

9. The method of claim 8 wherein the new error value is computed by computing the difference between a speaker value corresponding to the turning 0N or turning OFF step most recently done to the speaker and an adjusted value equal to the present sample value minus the present error value.

10. The method of claim 8, further comprising repeating the steps of claim 8 beginning with retrieving a present sample value for each sample value in the series of digital waveform sample values such that the speaker cone is positioned to emit sound corresponding to the series of digital waveform sample values.

11. The method of claim 8, further comprising selecting a next sample value and selecting an increment of the difference between the next sample value and the present sample value, and wherein the new error value is computed by computing the difference between a speaker value corresponding to the turning OFF or turning ON step most recently done to the speaker and an adjusted value equal to the present sample value minus the present error value minus the increment if the next sample value is less than the present sample value and plus the increment if the next sample value is greater than the present sample value.

12. The method of claim 8 wherein the threshold value equals a negative hysteresis value when the most recent action done to the speaker was to turn it ON and the threshold value equals a positive hysteresis value when the most recent action done to the speaker was to turn it OFF.

13. The method of claim 8 wherein the new error value is computed by computing the difference between a speaker value corresponding to the turning 0N or turning OFF step most recently done to the speaker and an adjusted value equal to the present sample value minus the present error value.

14. A method of producing sound from a standard computer speaker having a speaker cone, comprising:

retrieving a present sample value from a series of digital waveform sample values;

determining whether a present error value is less than a predetermined hysteresis value;

if the present error value is less than the hysteresis value, turning ON the speaker;

if the hysteresis value is negative, altering the hysteresis value to make it positive;

if the present error value is not less than the hysteresis value, turning OFF the speaker, and altering the hysteresis value by making it negative;

computing a new error value; and for one or more iterations, repeating the steps beginning with the determining step using the new error value as the present error value, such that the speaker cone is positioned to emit sound corresponding to the present sample value.

15. The method of claim 14 wherein the new error value is computed by computing the difference between a speaker value corresponding to the turning 0N or turning OFF step most recently done to speaker and an adjusted value equal to the present sample value minus the present error value.

16. The method of claim 14, further comprising repeating the steps of claim 13 for each sample value in the series of digital waveform sample values such that the speaker cone is positioned to emit sound corresponding to the series of digital waveform sample values.

17. The method of claim 14, further comprising selecting a next sample value and selecting an increment of the difference between the present sample value and a new sample value, and wherein the new error value is computed by computing the difference between a speaker value corresponding to the turning ON or turning OFF step most recently done to the speaker and an adjusted value equal to the present sample value minus the present error value minus the increment if the next sample value is less than the present sample value and plus the increment if the next sample value is greater than the present sample value.

18. A method of producing sound from a standard computer speaker having a speaker cone, comprising:

selecting a present error value;

selecting a threshold value;

retrieving a present sample value from a series of digital waveform sample values;

retrieving a next sample value from the series of digital waveform sample values;

determining whether the present sample value minus a present error value is greater than a threshold value;

turning ON the speaker if the present sample value minus the present error value is greater than the threshold value;

turning OFF the speaker if the present sample value minus the present error value is greater than the threshold value; computing a new error value; and for one or more iterations, repeating the steps beginning with the determining step using the new error value as the present error value and biasing the method during at least one of the iterations, such that the speaker cone is positioned to emit sound corresponding to values ranging from the present sample value to the next sample value.

19. The method of claim 18 wherein the method is biased by:

computing the difference between the present sample value and the next sample value;

computing an increment equal to the difference between the samples divided by a predetermined number of times X that the method is to be biased for the present sample value;

storing the increment computed as the initial increment;

if the next sample value is greater than the present sample value, adding the increment to the new error value computed;

if the next sample value is less that the present sample value, subtracting the increment from the new error value computed;

altering the increment by adding the initial increment to the increment; and repeating $X-1$ times, the steps beginning with the adding or subtracting step depending on the results of the comparisons made.

20. The method of claim 18 wherein the method is biased during each repetition of the steps of claim 18.

* * * * *